US007104725B1

(12) United States Patent
Kipp et al.

(10) Patent No.: US 7,104,725 B1
(45) Date of Patent: Sep. 12, 2006

(54) CONCRETE FINISHING ATTACHMENT

(76) Inventors: Kelly Kipp, P.O. Box 107, 94 Back Rd., Lost City, WV (US) 26810; John H. Kipp, Jr., 205 F Broadway Ave., Broadway, VA (US) 22815

( * ) Notice: Subject to any disclaimer, the term of this patent is extended or adjusted under 35 U.S.C. 154(b) by 182 days.

(21) Appl. No.: 11/110,185

(22) Filed: Apr. 20, 2005
(Under 37 CFR 1.47)

Related U.S. Application Data

(60) Provisional application No. 60/564,219, filed on Apr. 22, 2004.

(51) Int. Cl.
*E01C 19/22* (2006.01)

(52) U.S. Cl. ..... 404/112

(58) Field of Classification Search ..... 404/112; 15/180, 235.4
See application file for complete search history.

(56) References Cited

U.S. PATENT DOCUMENTS

| | | | | |
|---|---|---|---|---|
| 2,103,311 | A * | 12/1937 | Atkin | 15/180 |
| 2,836,056 | A * | 5/1958 | Drummond | 404/112 |
| 2,860,506 | A * | 11/1958 | Drummond | 404/112 |
| 4,281,496 | A | 8/1981 | Danielsson | |
| 4,865,227 | A | 9/1989 | Stephens | |
| 5,221,156 | A * | 6/1993 | Martin | 404/97 |
| 5,372,452 | A | 12/1994 | Hodgson | |
| 5,468,176 | A | 11/1995 | Udert et al. | |
| 5,911,620 | A | 6/1999 | Spangenberg et al. | |
| 6,021,771 | A | 2/2000 | Swan et al. | |
| 6,058,922 | A | 5/2000 | Sexton | |
| 6,139,217 | A | 10/2000 | Reuter | |
| 6,264,397 | B1 | 7/2001 | Majewski | |
| 6,299,522 | B1 | 10/2001 | Lee | |
| 6,527,634 | B1 | 3/2003 | Lee et al. | |
| 6,533,650 | B1 | 3/2003 | Yoshida et al. | |
| 6,637,974 | B1 | 10/2003 | Glenn | |
| 6,857,815 | B1 * | 2/2005 | Allen et al. | 404/75 |
| 2002/0025224 | A1 | 2/2002 | Williamson | |
| 2003/0217743 | A1 | 11/2003 | Gardner | |

FOREIGN PATENT DOCUMENTS

| | | | |
|---|---|---|---|
| DE | 196 04 540 | * | 8/1997 |
| EP | 0535 431 | | 4/1993 |

* cited by examiner

*Primary Examiner*—Gary S. Hartmann
(74) *Attorney, Agent, or Firm*—Bowles Rice McDavid Graff & Love LLP; John J. Giblin, Jr.; Anthony P. Tokarz

(57) ABSTRACT

A concrete finishing attachment for final finishing or troweling of concrete using a portable hand power tool, such as an angle grinder, comprised of a central hub formed into a frustrum shape with a hole located centrally for registration with the spindle or arbor of the tool, and having a plurality of vanes, preferably four, disposed radially around the perimeter of the hub. Each vane has a leading stabilizer, followed by an inclined tab orientated obliquely downward relative to the stabilizer, followed by a finishing blade oriented obliquely upward relative to the inclined tab, but still obliquely downward at a slight angle. Each vane engages with the hub along the inner edge of the arc sector formed by the stabilizer. The concrete finishing attachment is used by registering the spindle of the power tool with the hole in the hub and securing with a nut or other means.

8 Claims, 4 Drawing Sheets

CONCRETE FINISHING ATTACHMENT

This application claims benefit of Provisional Application No. 60/564,219, filed Apr. 22, 2004, now abandoned.

BACKGROUND OF THE INVENTION

1. Field of the Invention

The present invention relates to a portable tool for hand-finishing concrete. In particular, the invention relates to a rotary attachment to a hand-held powered tool for finishing concrete.

2. Description of the Related Art

Construction of buildings and other civil works typically involve the use of concrete. Construction using concrete involves the tasks of first placing and then, usually, finishing the concrete. Placing concrete involves pouring or otherwise placing concrete, while in a fluid state, into forms having the desired shape of the finished, cured concrete product. Finishing concrete involves treatment of the exposed surface of the concreted after pouring into the forms to achieve a desired texture and surface hardness.

Concrete is a mixture of cement, aggregates and water. The aggregates are comprised of various grades of sand or gravel, and are selected dependant upon the desired final properties, such as strength, smoothness and cost of the final concrete product. The cement acts as a binder between the aggregate particles. The cement, typically Portland cement, is comprised principally of calcium oxide, which is produced by roasting calcium carbonate, found in common minerals such as limestone and chalk. When the finished cement is mixed with water, the calcium oxide undergoes the chemical reaction of hydration, producing a hard crystalline structure around the particles of the aggregate, cementing them together.

The first step in the concrete construction process is to mix the concrete ingredients. Cement, water and aggregates are placed in a mixer and blended to evenly disperse the ingredients and thoroughly wet the cement, producing a fluid slurry. The mixing process can be accomplished at the construction site by mixing the ingredients in a portable cement mixer. More commonly, though, it is accomplished in a concrete mixing truck at a central plant. The concrete ingredients are added to the truck at the central plant, and the ingredients are mixed and blended while the truck is en route to the construction site.

Once the concrete is mixed and transported to the construction site, the concrete still in a slurry state, is placed within pre-constructed forms. Once placed within forms, the concrete is consolidated and finished. Consolidating the concrete is accomplished using a solid or vibratory rod which is inserted into the placed concrete, and assures that the concrete slurry fills all voids within the concrete forms and no air bubbler or rock pockets remain.

The final step in concrete construction is finishing of the placed, consolidated concrete. Finishing typically involves the steps of screeding, floating and troweling the concrete. Screeding involves leveling the surface of the poured concrete slurry across the top edges of the forms, producing a flat, though rough surface. Screeding removes any humps or hills and fills in any depressions or voids in the surface. Screeding is following by floating, a process which provides a smoother, harder surface than that remaining after the screeding process. Floating is done after the concrete has begun to harden but is still in a plastic state. Floating uses a tool called a float or bull float, typically made with a flat plate of aluminum, magnesium, wood or rubber. A small handle is attached parallel to the upper surface of the float. An operator holds the handle and sweeps the lower surface of the float across the surface of the screed concrete. For larger areas, a bull float is used, which has a longer plate and a long pole handle disposed at an angle to the upper surface of the plate.

The next step in concrete finishing is troweling, in which the floated surface is troweled to force downward any large surface aggregate particles and to produce an even harder, denser, smoother surface. Troweling can be accomplished using a hand trowel or a troweling machine. The hand trowel is comprised of a small, flat, rectangular metal sheet with a handle disposed parallel on the upper surface of the metal sheet. Troweling by hand is accomplished by holding the handle in one hand, pressing the undersurface of the trowel against the concrete surface, applying a slight torque to the handle to apply greater pressure on the trailing edge of the trowel, and then sweeping the trowel across the surface of the concrete. With practice, an operator learns the correct amount of pressure and torque to apply to the trowel handle to achieve the desired surface finish.

The troweling machine is generally comprised of a vertical shaft motor or engine with typically four flat, horizontal blades disposed orthogonally at the lower end of the motor shaft. Each blade is slightly canted from the direction of rotation to lower its trailing edge. A handle assembly is disposed at the upper end of the engine for controlling the troweling machine by an operator. The engine rotates the blade assembly across the surface of the concrete, which quickly smoothes and finishes the concrete before it fully hardens. The troweling machine can finish larger areas of concrete surfaces more quickly and with less labor than is possible by traditional hand troweling. However, the size of the troweling machine, in which the blade assembly typically has a diameter of three feet or more, precludes its use on smaller areas, such as on treads of concrete stairs, on the top edges of curbs, on concrete countertops and other surfaces with limited size or access. In these circumstances, a motorized system for troweling is desirable to increase productivity over hand troweling yet capable of reaching small or confined surfaces not presently accessible by larger troweling machines.

Several hand tools are commercially available which could be adapted as a portable powered concrete finisher. For example, an angle grinder has an elongated body containing an electric or pneumatic motor which is small and light enough to be held by hand. At the front end of the angle grinder is disposed a spindle orientated orthogonally to the major axis of the body of the grinder. A variety of circular attachments may be mounted on this spindle, such as grinding wheels, abrasive cutoff wheels, sanding disks and buffing and polishing wheels. However, no attachment is presently available in the prior art which is capable of troweling concrete.

SUMMARY OF THE INVENTION

To overcome the limitations of the prior art, the present invention is directed to an attachment to a portable powered hand tool for finishing concrete. The concrete finishing attachment may be installed on common hand tools, such as an angle grinder, and used to trowel or finish concrete surfaces which are too small or inaccessible for the larger, commonly available powered troweling machines. The concrete finishing attachment is circular with a centrally disposed hub. The hub has a frustrum shape with an aperture in its top surface for mounting on the spindle of an angle grinder or similar powered hand tool. A plurality of vanes are evenly disposed radially around the outer edge of the hub. Each vane has a stabilizer, an inclined tab and a finishing blade section. The inner edge of each stabilizer conjoins with the outer edge of the hub. Each stabilizer section has a leading edge extending radially from the hub. The inclined tab is disposed on the stabilizer opposite from the leading edge, and at a downward obtuse angle with the stabilizer. At the opposite side of the inclined tab is disposed the finishing blade. The finishing blade is angled so that it is canted slightly downward from the plane of the stabilizer. The vanes, or at least the finishing blades, are fabricated of an elastic metal such as spring steel.

The concrete finishing attachment is mounted on a powered rotary hand tool, such as an angle grinder. The hand tool rapidly rotates the concrete finishing attachment, and the operator presses the rotating finishing blades against the unfinished concrete. The lower surfaces of the finishing blades trowel and finish the unfinished concrete as effectively but more quickly and efficiently than hand troweling. However, with its smaller size, it is not precluded from use on smaller or less accessible areas.

In another embodiment of the present invention, some of the finishing blades are replaced with blades fabricated of magnesium, aluminum or wood, and are orientated parallel with the plane of the stabilizers. These may then be used for floating the concrete prior to troweling.

In another embodiment of the invention, the plurality of vanes are replaced with a single stabilizing annular disk, the inner circumference of which communicates with the outer edge of the hub. On the lower surface of the disk are disposed a plurality of vanes, each vane having an inclined tab disposed at its leading edge to the stabilizer disk, and a troweling blade at its opposite edge. Similar to the first embodiment, the troweling blade is orientated at a slight angle downward from the plane of the stabilizer disk.

One objective of the present invention is to provide an apparatus for troweling an unfinished small concrete surface areas with a lightweight, handheld power tool.

Another objective of the present invention is to provide an attachment for troweling concrete that may be used with presently available power tools.

A further objective is to provide an apparatus for floating as well as troweling a small, screed concrete surface area using a powered hand tool apparatus.

These and other objectives and advantages of the invention will become apparent from the description which follows. In the description, reference is made to the accompanying drawings, which from a part hereof, and in which is shown by way of illustration specific embodiments in which the invention may be protected. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

DETAILED DESCRIPTION OF THE PREFERRED EMBODIMENTS

Figure 1:
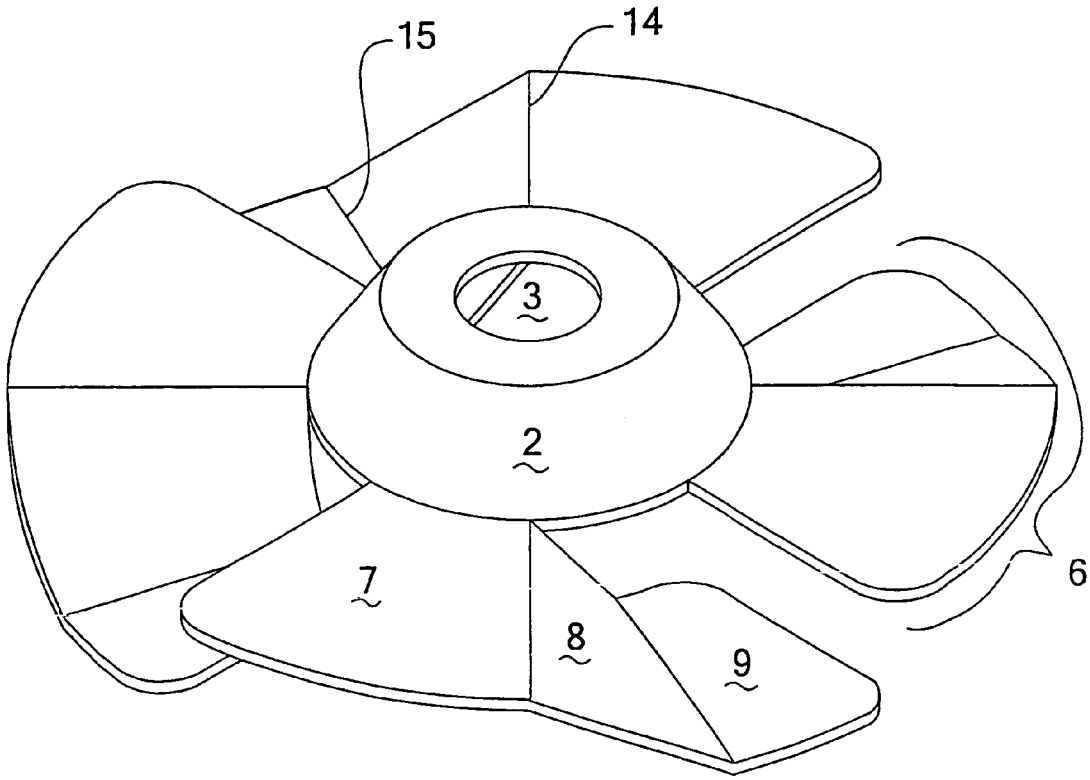
FIG. 1 is a perspective view of the preferred embodiment of the invention.

The present invention is directed to an attachment for portable powered rotary hand tools for finishing unfinished concrete. As shown in FIG. 1, a concrete finishing attachment 1 is a circular apparatus with a central hub 2. The hub 2 is shaped in a frustrum, with solid top and sides and an open bottom. Disposed centrally in the top surface of the frustrum is an aperture 3 sized suitably to register with the spindle 4 or arbor of a rotary powered handheld tool, such as an angle grinder. The typical size of the spindles 4 of angle grinders is ⅝ inch. The width of the top section is sufficient to allow a mounting nut 5, shown in FIG. 3, to seat flush against the underside of the top of the hub 2 when the concrete finishing attachment 1 is mounted on the spindle 4 of a hand power tool.

A plurality of vanes 6 are disposed radially around the hub 2. Each vane 6 has arcuate inner and outer edges and is comprised of three sections, a stabilizer 7, an inclined tab 8, and a finishing blade 9. The inner edge of the stabilizer 7 engages with the outer edge of the hub 2. The stabilizer 7 has a radial leading edge 10 disposed in the direction of rotation of the tool upon which it is mounted. This is typically counterclockwise by industry convention, when viewed from above. The plane of each stabilizer 7 surface is parallel to the plane of the top of the hub 2, so that the plane of each stabilizer 7 is orientated normal to the axis of the spindle upon which the concrete finishing attachment 1 is mounted.

The inclined tab 8 conjoins with the stabilizer 7 at a radial first crease 14 opposite from the leading edge 10 of the stabilizer 7. The plane of inclined tab 8 is orientated downward (i.e., away from the body of the power tool when the concrete finishing attachment 1 is mounted thereon) from the stabilizer 7 at an angle, preferably 45 degrees. Depending on the method of manufacture, the crease may have a sharp angle between the surfaces of the stabilizer 7 and inclined tab 8, or may present a beveled or rounded transition between the two sections.

The finishing blade 9 conjoins with the inclined tab 8 at a radial second crease 15 opposite from the first crease 14. The finishing blade 9 is orientated to the inclined tab 8 at an upward angle slightly less than the angle of the inclined tab 8 from the stabilizer 7. This orientation disposes the finishing blade 9 at a slight angle downward from a plane parallel to that of the stabilizer 7. In this orientation, when the concrete finishing attachment 1 is used, the finishing blade 9 first contacts the concrete surface at its trailing edge 11. As in the first crease 14, the second crease 15 may be sharp or rounded.

Preferably, the stabilizer 7 section comprises approximately one-half of the arc sector of the vane 6. The inclined tab 8 and the finishing blade 9 each comprise approximately one-fourth of the arc sector of each vane 6. Thus, for example, in a concrete finishing attachment 1 with four vanes, 6 each vane 6 would comprise an arc sector of 90 degrees, with the stabilizer 7 section extending 45 degrees and the inclined tab 8 and finishing blade 9 sections each extending 22-½ degrees.

The overall diameter of the concrete finishing attachment 1 can vary, dependant upon the nature and power of the tool on which it is intended to be used and the application to which it will be applied. Preferably the diameter is 6-½ inches, which roan be used on the most popular sized angle grinders.

Figure 2:
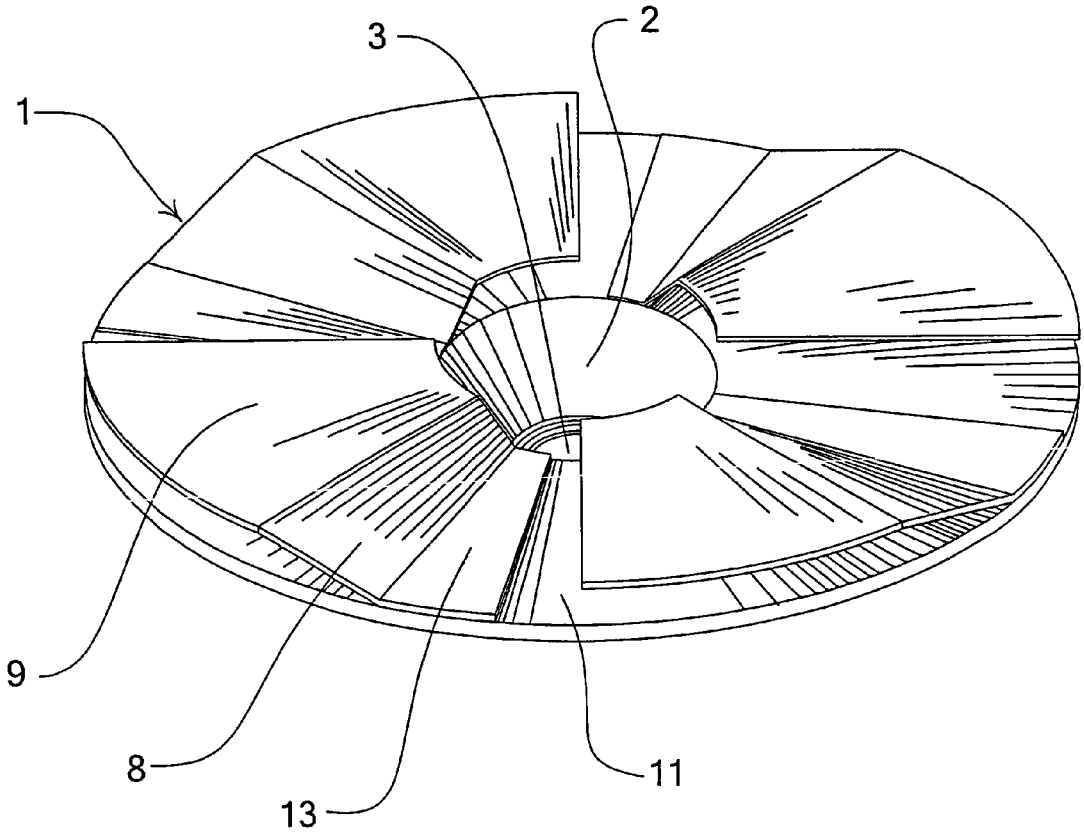
FIG. 2 is a perspective view of an alternative embodiment of the invention viewed fro the underside.

An alternative embodiment of the invention, shown in FIG. 2, is comprised of a frustrum-shaped hub 2 with a central aperture 3 on the top surface of the hub 2. Disposed around the outer perimeter of the hub 2 is an annular disk 12. Like the stabilizers 7 of the first embodiment, the annular disk 12 is orientated with the plane of its surface parallel to the plane of the top surface of the hub 2, so that the annular disk 12 will be normal to the longitudinal axis of the spindle when the concrete finishing attachment 1 is mounted thereon. The annular disk 12 has a lower surface reverse from the hub 2. On the lower surface of the annular disk 12 are radially disposed a plurality, preferably four, of vanes 6. Each vane 6 forms an arc sector equally spaced around the annular disk 12 and has a trailing edge 11. Each vane 6 is comprised of a mounting section 13, and inclined tab 8 and a finishing blade 9, each of which form a planar arc sector of the vane 6. The mounting section 13 has an upper surface which communicates flush with the lower surface of the annular disk 12. The mounting section 13 conjoins with the annular disk 12 by one of various means known in the art, such as riveting or welding. Alternatively, the mounting section 13 may be conjoined with removable means, such as screws, to permit replacement of a vane 6.

The inclined tab 8 is an inclined planar arc sector bounded by the outer and inner circumferences of the vane 6 and by a radial first crease 14 with the mounting section 13. The inclined section forms an angle with the mounting section 13 at the first crease 14, such that the inclined tab 8 is disposed downward from the plane of the annular disk 12 at an angle, preferably about 45 degrees.

Finally, the finishing blade 9 is a planar arc sector conjoining with the inclined tab 8 at a radial second crease 15 opposite from the first crease 14. The finishing blade 9 is orientated to the inclined tab 8 at an upward angle slightly less than the angle between the inclined tab 8 and the mounting section 13. This orientation disposes the finishing blade 9 at a slight angle downward from a plane parallel to that of the mounting section 13 and the annular disk 12. In this orientation, when the concrete finishing attachment 1 is used, the finishing blade 9 first contacts the concrete surface at its trailing edge 11.

As in the first embodiment, the shape of the first and second creases 14, 15 may be sharply angular or beveled and rounded, depending upon the selected method of manufacture.

The preferred method for fabricating the preferred embodiment of the concrete finishing attachment 1 is by stamping from a piece of sheet stock of spring steel or stainless steel. In a stamping process, the die is designed to make four "L" shaped cuts (or a number of cuts equal to the number of desired vanes). One leg of each cut is radial, dividing the leading edge 10 of a stabilizer 7 from the trailing edge 11 of what will be the preceding finishing blade 9. The first leg of the cut extends radially inward to the outer edge of the hub 2. The second leg of the cut is made circumferentially from the inner end of the first cut counterclockwise along the outer edge of the hub 2 to the desired combined width of the finishing blade 9 and inclined tab 8. The stamping die then creates the radial first crease 14 demarcating the boundary between the stabilizer 7 and the inclined tab 8, and the second radial crease 15 demarcating the inclined tab 8 and the finishing blade 9. The die also forms the center section into the frustrum hub 2 and punching out the center aperture 3.

For the alternative embodiment, in which vanes 6 are separately fabricated and affixed to the stabilizing disk, the vanes 6 are formed into the desired shape by conventional sheet metal processes well known in the art. The body of the concrete finishing attachment 1 is fabricated by providing a circular disk, on which the hub 2 and center aperture 3 are stamped similar to the method for the preferred embodiment, and thereby forming the annular disk 12 surrounding the frustrum hub 2. The mounting section 13 of each vane 6 is affixed to the underside of the annular disk 12 using means known in the art such as rivets, welding or screws. For removable vanes 6, mounting holes are drilled and tapped into the annular disk 12 to accept screws.

In either embodiment, the vanes 6, or at least the finishing blade 9 section, is made preferably of spring steel. Spring steel provides sufficient elastic flexibility to permit an increasing area of the finishing blade 9 to contact the unfinished concrete 18 surface by applying increasing downward pressure on the concrete finishing attachment 1.

The concrete finishing attachment 1 may also be used in the floating step. In this application, where the concrete surface still contains higher levels of moisture, spring steel would suffer corrosion. For use in floating, the preferred materials of construction for the concrete finishing attachment 1 include aluminum, magnesium, wood, plastic or rubber. A concrete finishing attachment 1 fabricated of spring steel could also be used for floating by adhering a layer of cork to the lower surface of the finishing blade 9.

Figure 3:
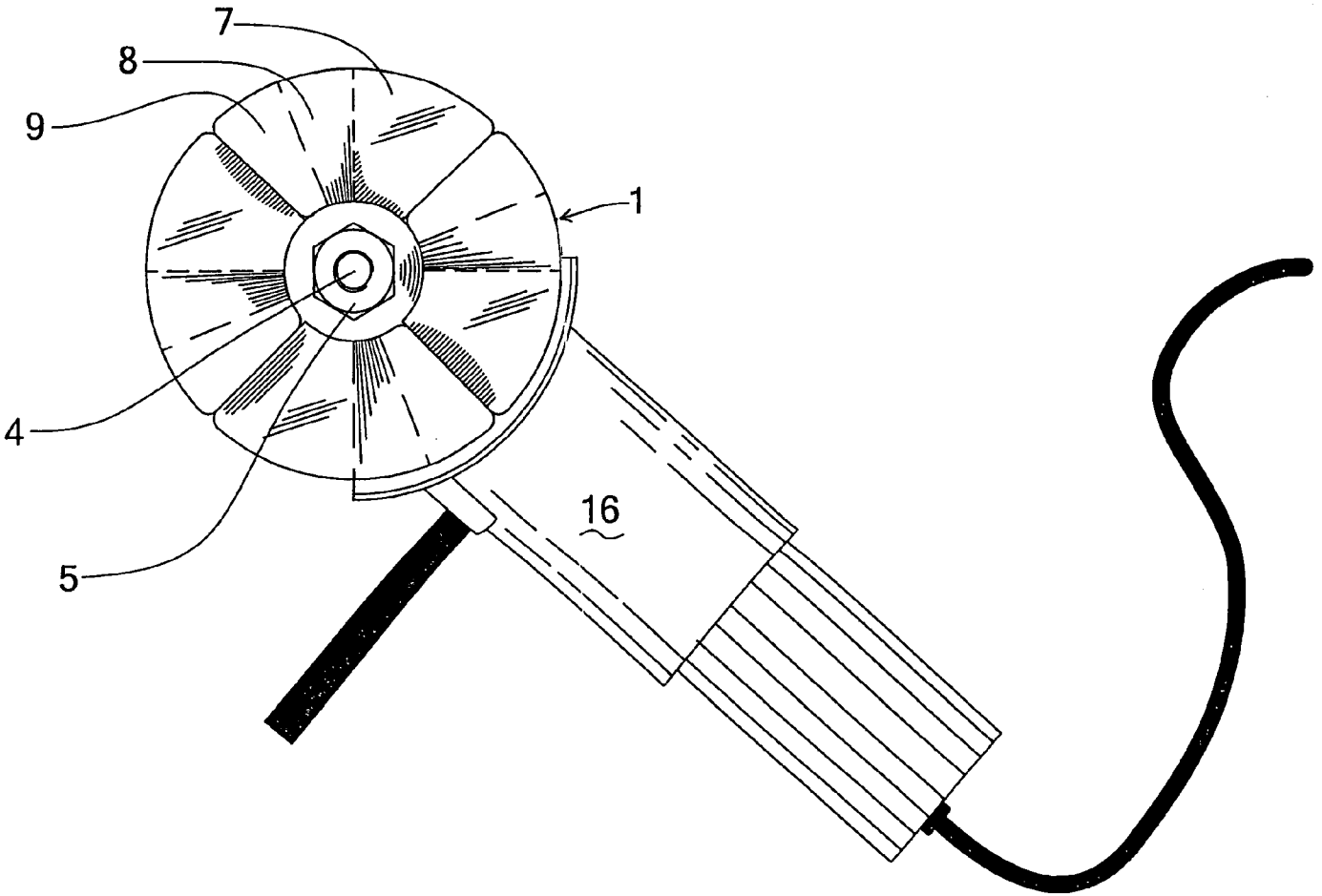
FIG. 3 is a diagram showing the invention mounted on an angle grinder.

As shown in FIG. 3, the concrete finishing attachment 1 is utilized by registering the aperture 3 at the center of the hub 2 with the spindle 4 or arbor of a portable powered hand tool, such as an angle grinder 16. Once the spindle 4 registers with the aperture 3, the hub 2 is advanced along the spindle 4 until the top surface of the hub 2 communicates flush with the base of the spindle 4. A nut is engaged with the spindle 4, and is advanced along the spindle 4 within the interior of the conical section of the hub 2, until the nut communicates with the underside of the top surface of the hub 2. An adequate torque is applied to the nut to secure it firmly in place against the concrete finishing attachment 1.

Figure 4:
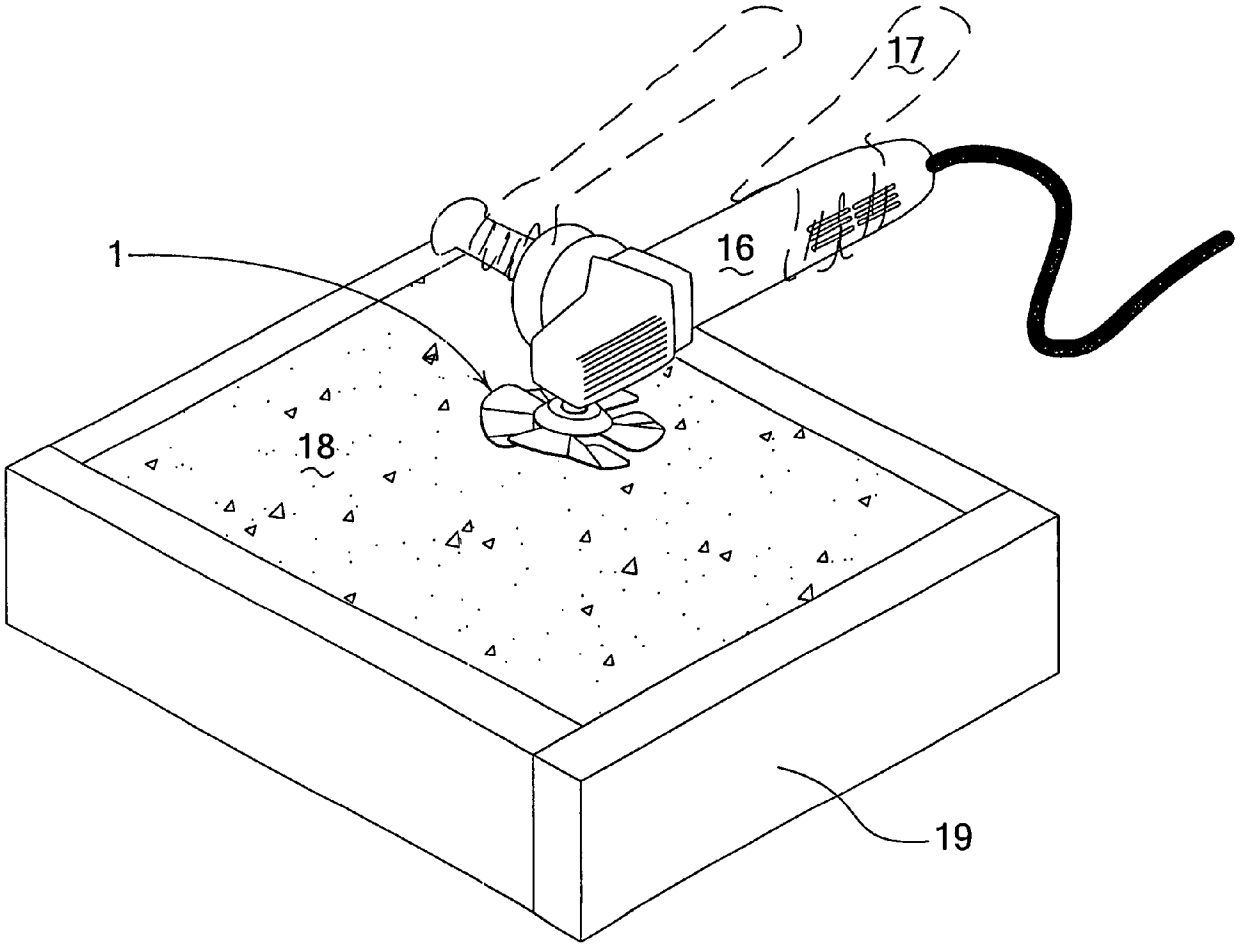
FIG. 4 is a diagram demonstrating the use of the invention.

The concrete finishing attachment 1 is used in a manner similar to other attachments for an angle grinder 16 or similar power tools. As shown in FIG. 4, the body of the power tool is held in one hand and the orthogonal handle, if so provided, by the other. The motor of the power tool is engaged, causing the concrete finishing attachment 1 to rotate rapidly. The power tool is held so as to position the rotating concrete finishing attachment 1 in a horizontal plane over the surface of unfinished concrete 18, which has been previously poured with forms 19 and screed and floated. The tool is vertically lowered until the lower surfaces of the finishing blades 9 contact with the surface of the unfinished concrete 18. The trailing edges 11 of the finishing blades 9 first contact the concrete surface, but additional vertical pressure causes a slight warp in the spring steel blades, causing progressively greater areas of the finishing blades 9 to contact the concrete surface. The rotating concrete finishing attachment 1 is then swept across the concrete surface, usually in an arcing motion. An operator 17 quickly develops by practice an intuitive feel for the correct amount of pressure to apply to the rotating concrete finishing attachment 1 to achieve the desired surface finish.

While various embodiments of the invention have been described above, it should be understood that they have been presented by way of example, and not limitation. It will be apparent to person skilled in the relevant art that various changes in form and detail may be made therein without departing from the spirit, and scope and application of the invention. This is especially true in light of technology and terms within the relevant art that may be later developed. Thus, the present invention should not be limited by any of the above-described exemplary embodiments, but should only be defined in accordance with the appended claims and their equivalents.

We claim:

1. A concrete finishing attachment for final finishing of concrete using a portable hand power tool, comprising:

a. a hub, having a frustrum shape with solid top and sides and open bottom and interior, and an outer edge disposed at the bottom of the conical side, said hub further having an aperture disposed centrally in the top of the hub;

b. an annular stabilizing disk, comprising a circular disk having inner and outer edges with concentric radii of curvature, wherein said inner edge of the annular disk communicates with the outer edge of said hub, and further comprising a lower surface;

c. a plurality of vanes disposed radially on the lower surface of the annular disk, each said vane having a radial trailing edge, wherein each vane is comprised of a mounting section, an inclined tab and a finishing blade, and wherein the inclined tab is obliquely disposed to the mounting section and the finishing blade is disposed obliquely to the inclined tab, and wherein the mounting section engages with the lower surface of the annular stabilizing disk.

2. The concrete finishing attachment of claim 1, wherein the vanes are fabricated of spring steel.

3. The concrete finishing attachment of claim 1, wherein the vanes are fabricated of a material selected from the group comprised of spring steel, magnesium, aluminum, wood, plastic and rubber.

4. The concrete finishing attachment of claim 1, wherein the finishing blade is further comprised of a layer of cork disposed on its lower surface.

5. The concrete finishing attachment of claim 1, wherein the number of vanes equals four.

6. The concrete finishing attachment of claim 1, wherein the finishing blade is disposed obliquely downward relative to the stabilizing disk.

7. The concrete finishing attachment of claim 1, wherein the mounting section engages with the stabilizing disk by rivets or screws.

8. A method for finishing a concrete surface, comprised of providing a concrete finishing attachment as described in claim 1, engaging said concrete finishing attachment to a portable hand power tool, rotating the concrete finishing attachment with said power tool, and engaging the concrete finishing attachment with the surface of the concrete.

* * * * *